United States Patent [19]

Carlisle et al.

[11] 4,099,822

[45] Jul. 11, 1978

[54] CONNECTOR FOR MAKING SPLICING, HALF-TAP, BRIDGING AND TERMINATING CONNECTIONS OF MULTIPLE INSULATED CONDUCTORS

[75] Inventors: Arthur Wallace Carlisle; Dean Rudisill Frey, both of Dunwoody, Ga.

[73] Assignee: Bell Telephone Laboratories, Incorporated, Murray Hill, N.J.

[21] Appl. No.: 761,978

[22] Filed: Jan. 24, 1977

[51] Int. Cl.[2] ..... H01R 9/08

[52] U.S. Cl. ..... 339/98

[58] Field of Search ..... 339/97 R, 97 P, 98, 339/99 R

[56] References Cited

U.S. PATENT DOCUMENTS

| | | | |
|---|---|---|---|
| 3,308,418 | 3/1967 | Hedstrom | 339/97 R |
| 3,611,264 | 10/1971 | Ellis, Jr. | 339/99 R |
| 3,798,587 | 3/1974 | Ellis, Jr. et al. | 339/97 P |
| 3,854,114 | 12/1974 | Kloth et al. | 339/97 R |
| 3,963,300 | 6/1976 | Patton et al. | 339/99 R |
| 3,976,350 | 8/1976 | Keglewitsch | 339/97 P |

FOREIGN PATENT DOCUMENTS

| | | | |
|---|---|---|---|
| 2,500,189 | 7/1975 | Fed. Rep. of Germany | 339/99 R |

*Primary Examiner*—Joseph H. McGlynn

*Attorney, Agent, or Firm*—Charles E. Graves; John W. Fisher

[57] ABSTRACT

A family of connectors is described for splicing, half-tapping, bridging and terminating multiple insulated wires. The connectors are particularly suitable to telephone central office applications requiring limited numbers of conductor reconnections. The basic connector consists of a mandrel around which the wires of a wire group are looped, a mandrel holder which retains the wires in loop-around configuration; and a contact module containing double-ended split beam contacts. Physical connection between wires mounted on two mandrels is made by inserting the mandrels into respective holders; and then mounting the two resulting assemblies on respective sides of a contact module. Advantageously, each mandrel holder may be double-sided to receive two mandrels. Correspondingly, the contact module may be designed to mount double-sided mandrel holders. A stack consisting of mandrels in their holders alternating between contact modules can provide for multiple appearances of wires in a given wire set.

12 Claims, 26 Drawing Figures

CONNECTOR FOR MAKING SPLICING, HALF-TAP, BRIDGING AND TERMINATING CONNECTIONS OF MULTIPLE INSULATED CONDUCTORS

FIELD OF THE INVENTION

This invention relates to electrical wire connections; and more specifically, to gang connections between two or more wire groups, particularly in telephone cable connecting including, importantly, connections made in telephone central offices.

BACKGROUND OF THE INVENTION

In the electrical world, particularly in electronics and telecommunications, a large number of situations exist which require the connection of corresponding wires of two wire groups. The situations differ in their requirements; and thus various species of gang connectors have come into use with features designed to meet the particular requirements.

One increasingly useful gang connector features a slotted beam element to make the electrical connection. Particularly, double ended slotted beam connectors are an efficient medium for penetrating conductor insulation and making reliable electrical and mechanical connection between two wires. In past such connector designs, however, it has been difficult to combine low cost and structural simplicity with a capability for effecting several different types of wire connections.

For example, in modern telephone central offices there is much occasion to interconnect wires through splicing, half-tapping, and bridging; as well as to simply terminate wires singly or in groups to a connector block for future use. These needs are equally present in computer back plane wiring. Present connectors, however, are not sufficiently generic in concept and design to perform all such functions with equal ease. Moreover, the potential for double ended slotted beam elements has not been successfully extended to reliable reconnection of the same wires. In both central offices and computer backplanes, however, there is occasion for at least a limited number of rearrangements and reconnects of original wiring plans.

SUMMARY OF THE INVENTION

Pursuant to one broad aspect of the invention, flexibility of splice type is achieved by dressing the wires to be joined around a two-sided mandrel. The mandrel has separate guide channels for each wire, advantageously consisting of two pairs of opposed risers on either side each having interior insulation-gripping surfaces. Each wire is secured between the floor of the guide channel and the adjacent two riser pairs.

Each mandrel is received in the interior chamber of a mandrel holder, which advantageously is double-sided to accommodate two mandrels. The holder includes, for example, four staggered rows of orifices symmetrically placed through each major face. The end of a slotted beam connector extends through each orifice to engage the corresponding wire mounted around the mandrel and centered beneath the orifice.

The slotted beam connectors are housed in a contact module with the ends contained in individual protective towers extending vertically outward from either side of the contact module. Each tower mates with a one of the orifices of the mandrel holder. An assembly of wired mandrels and holders constitutes a receptacle for receiving two contact modules.

The looping of the wire in the receptacle offers the advantage that contact access is provided at the top and bottom sides of the receptacle for splicing, bridging and testing. The contact elements are designed to remain elastic and to provide a force such that repeated insertions can be made at the same point on the wires. This arrangement affords considerable flexibility in that a connector block can be added to either side of the receptacle to form the male side of the connector; or two receptacles can be joined through a single contact module at the time of splicing. Within this basic design provision is made for assembling all parts in the proper orientation only, thus to avoid faulty reconnections, through an inadvertant rotation of the mandrel with respect to its holder or rotation of a contact module with respect to a mandrel-holder assembly. Other design features further enhance the basic capability of this connector to achieve splice, half-tap and bridging connectors, as will now be demonstrated in detail.

DETAILED DESCRIPTION OF THE ILLUSTRATIVE EMBODIMENTS

Figure 1:
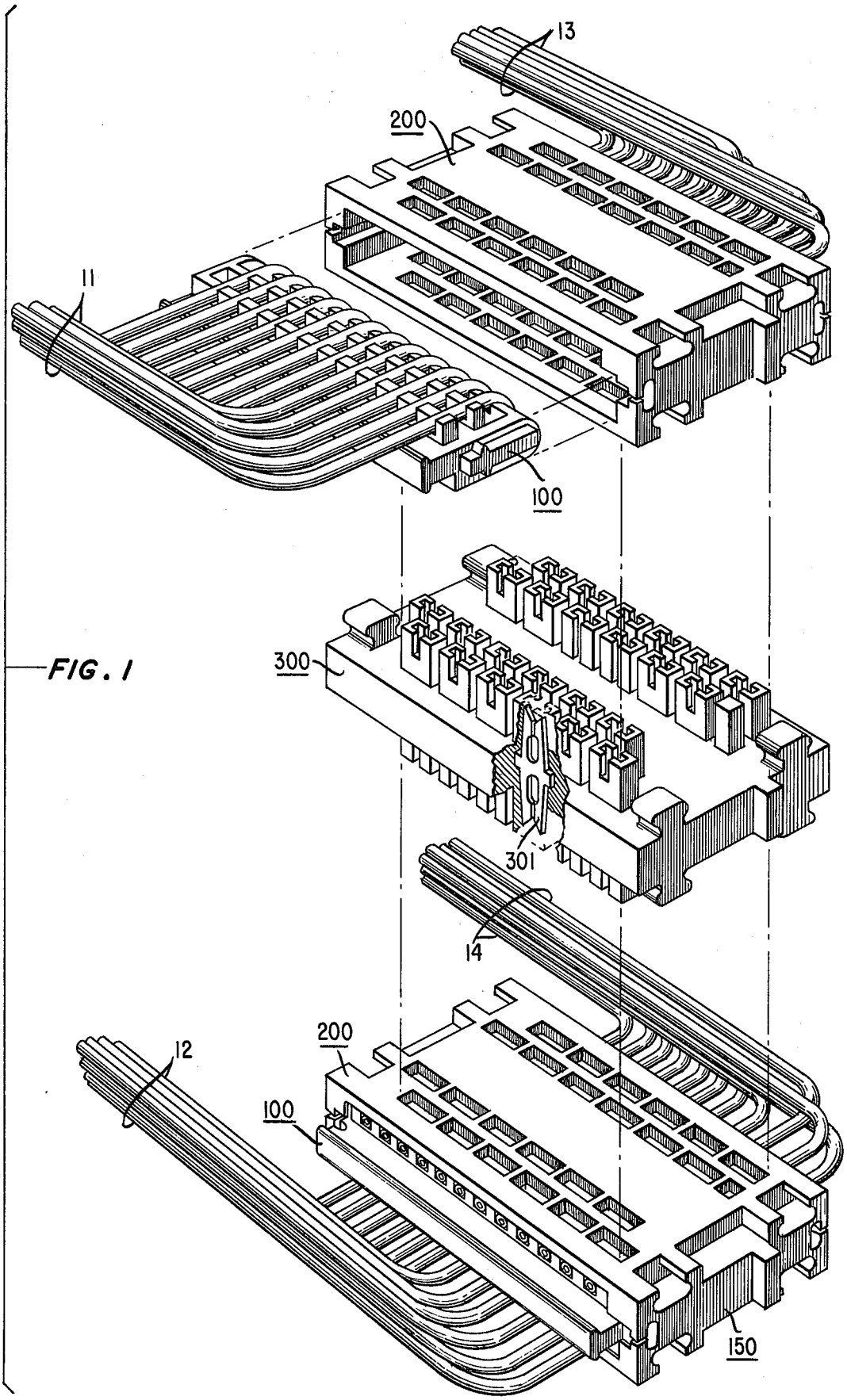
FIG. 1 is an exploded perspective view showing the assembling of mandrels into mandrel holders and the interconnecting of two such assembled units through a contact module.

The present invention in one exemplary embodiment is shown in FIG. 1, in a twelve-pair assembly version. A first group of twelve conductors denoted 11 is to be connected to a corresponding group of conductors denoted 12; these might be, for example, tip leads to be spliced. The corresponding ring leads which make up the pairs and which are to be connected together, are found in conductor groups 13 and 14.

Each of the conductor groups 11–14 is installed on a separate mandrel, such as mandrel 100. The four mandrels, two of which are visible in FIG. 1, are installed in pairs in mandrel holders 200. When so installed, as depicted in the bottom portion of FIG. 1, the two mandrels and their common mandrel holder 200 constitute a receptacle denoted 150.

Two such receptacles are then connected by a contact module 300 which houses, in the present embodiment, 24 insulation-piercing slotted beam connectors 301 in four staggered rows of six each. The mandrels 100 snap-mount into the holder 200; and the two receptacles 150 each are pressed onto the contact module 300. Covers, caps or other protection may then be afforded around the assemblage. The completed connection is a through-splice of the twelve conduction pairs which, for a given pair, is illustrated in cross-section conceptually in FIG. 2B.

Figure 2A:
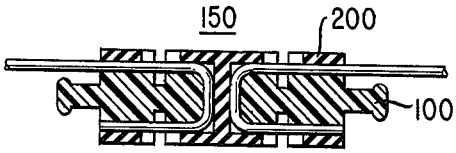
FIG. 2A illustrates a receptacle consisting of mandrels and a mandrel holder.
Figure 2B:
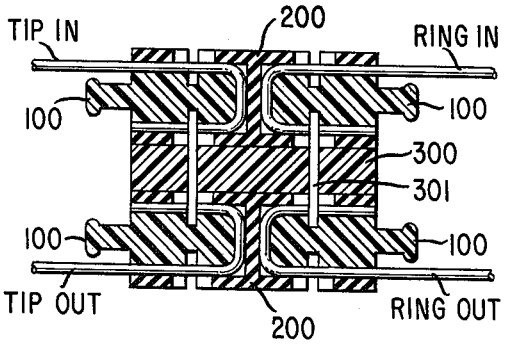
FIGS. 2B, 2C, and 2D are sketches in cross section variously illustrating conceptually the use of the invention in making through-splice, half-tap, and bridging connections.

Piggybacking as well as other variations on the basic invention are readily achieved. The basic receptacle 150 illustrated in FIG. 2A, can be wired in the manner shown in FIG. 2C, to achieve a half-tap splice without need for additional parts. Thus, the bottom receptacle denoted **150*a* in FIG. 2C is arranged to mount the bottom tip and ring conductors in loop-around fashion, the tip and ring conductors of top receptacle 150 being terminated on their mandrels 100**. This half-tap connection is useful for example in multipling several connectors on the same cable, or bridging a new cable onto an existing cable in preparation for the removal of a portion of the existing cable.

Figure 1A:
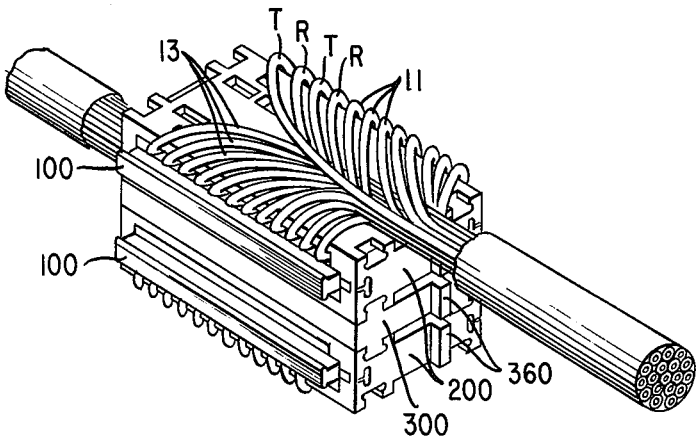
FIG. 1A is essentially the structure of FIG. 1, fully assembled.

The assembling of wires 11 and 13 into respective mandrels 100, and thereafter placing of the loaded mandrels into a mandrel holder 200, advantageously can take place at a factory location under more controlled conditions than normally exist in the field. With this much of the connector assembled in the factory, the splicing of two such receptacles 150 later on in the field into a splice such as depicted in FIG. 1A, is also appreciably faster.

Figure 2D:
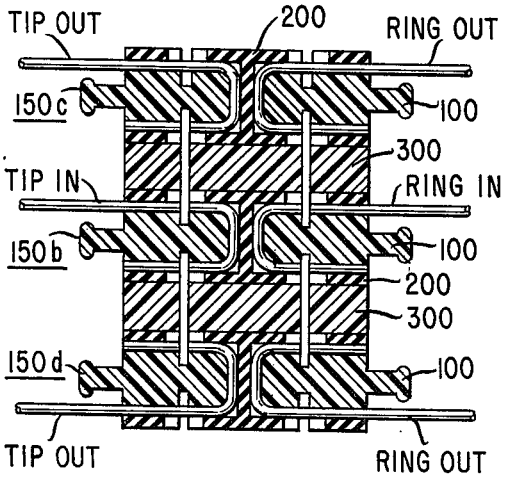
Figure 2C:
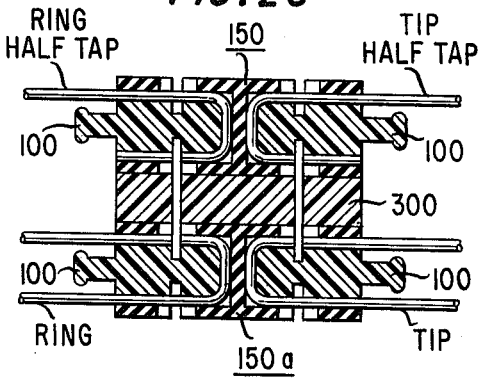

A further variation on the invention is shown conceptually in FIG. 2D, which depicts a bridging connection. The receptacle **150*b* mounts the tip-in and ring-in conductors. On either side of the receptacle 150*b* is mounted a contact module 300. To each of these is mounted, respectively, receptacle 150*c* supplying a first tip-out, ring-out pair, and receptacle 150*d*** supplying a second tip-out, ring-out pair. This type bridging connection is used extensively in a telephone plant, for example at points where multiple equipments are joined in parallel.

The use of two mandrels in a wire holder saves space; but the invention is equally applicable to a mandrel holder that accommodates a single mandrel. For example, the typical connections of the present invention as seen in FIGS. 2B, 2C and 2D, are symmetrical about a center plane normal to the sections shown; the connections made on either side of the center plane are self-sufficient and can be made as separate entities.

Telephone central office applications for the connector include intra-bay and inter-bay cable connections. The connector can be mounted directly to bay-type equipment using any of a number of mounting methods; or it can be dressed in the backplane area or in interior bay cable channels. The connector can also be placed in overhead cable racks in splicing and half-tap applications. In addition the connector can be adapted for use in station equipment located on customer premises.

The structural and functional details of the mandrel 100, the mandrel holder 200, and the contact module 300, used in this illustrative embodiment of the present invention, will now be described.

MANDREL

Figure 3:
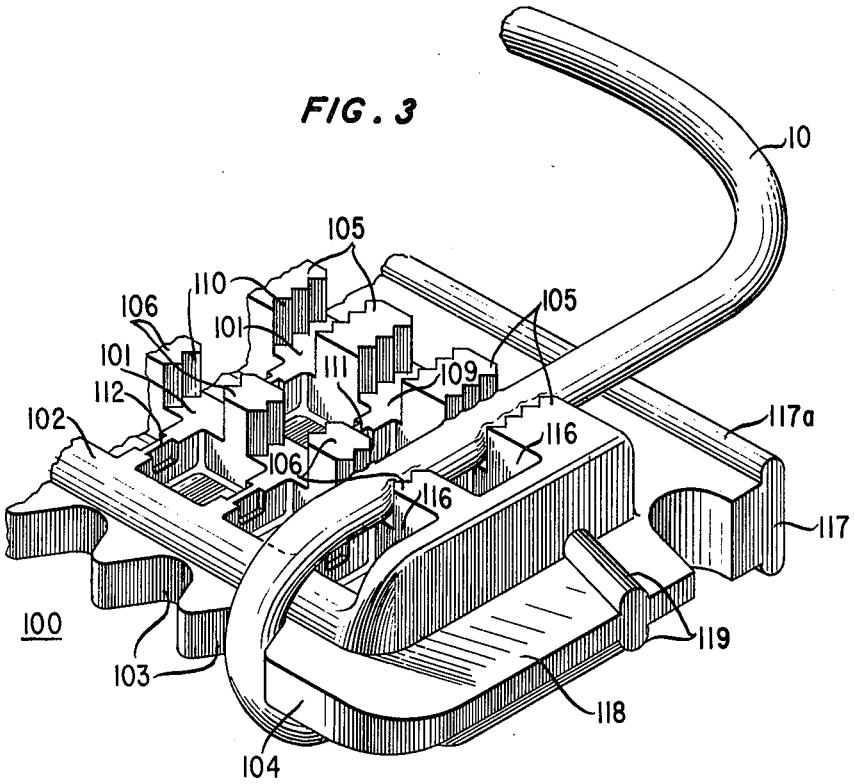
FIG. 3 is a schematic perspective partial view of the mandrel.
Figure 4:
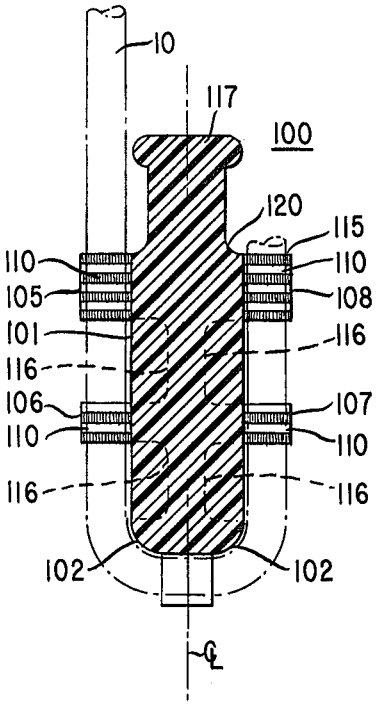
FIGS. 4 and 4A are sectional side views of the mandrel.

The basic function of mandrel 100 is to receive a plurality of wires, such as wire 10 in loop-around fashion as shown in FIGS. 3 and 4. The wires could be uninsulated, but more usually are insulated especially in telephone applications. The mandrel is essentially symmetrical about the center plane, denoted CL and shown in edge view in FIG. 4. Each wire is led across a surface **117*a* of rail 117; and then is placed between a first pair of risers 105 and a second pair of risers 106, all risers having wire-gripping teeth 110. The wire 10 is supported in this position by a floor 101 which runs between both pairs of risers 105, 106. Floor 101 includes a first reduced width section 111 located beyond risers 105, and a second reduced width section 112 beyond riser 106. Wire 10 is led around a curved surface 102 and into a wire guide 103, formed as an indentation in a shoulder 104 extending around the periphery of the mandrel 100**.

Figure 4A:
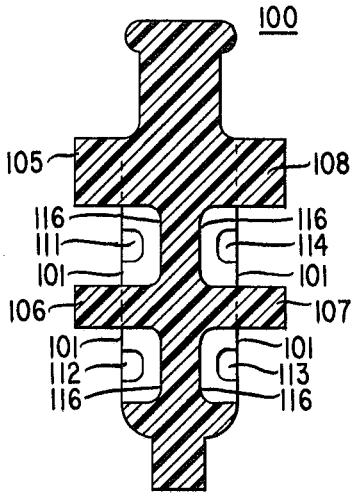

Thereafter, on the other side of the mandrel, wire 10 is led through mirror image counterparts of the elements just described, including toothed riser pairs 107, 108, and floor 101 with reduced width sections 113, 114. As best seen in FIGS. 4 and 4A, the wire 10 is supported on the floor 101 across sections 113 and 114, and through riser pairs 107, 108 which are also provided with wire gripping surfaces such as teeth 110. The wire may for some applications be severed at the point denoted 115 in FIG. 4; or for some purposes, may be looped fully around the mandrel 100 as depicted in FIG. 2C and terminated at some remote point.

Adjacent to each of the indents 111, 112, 113 and 114 is a clearance well 116 to receive portions of the contact module. The rail 117 provides a gripping surface to permit removal of the mandrel from its holder 200. The shoulder 104 extends beyond the two side edges of mandrel 100 in a tapered runner 118, as shown in FIG. 3. Rising symmetrically from either side of runner 118 is a knob 119 which interacts with the mandrel holder to latch the mandrel in place.

Thus, in general, each mandrel constitutes one or more continuous wire guide channels, defined by generally parallel entrance and exit legs as illustrated in FIG. 3. As seen in FIG. 4 the entrance and exit legs open onto the front side of the mandrel and are joined by a crossover formed across the rear side of the mandrel. The guides in general are U-shaped; and each contains a loop segment of a wire. The wire may extend out of both the exit and entrance legs; or one leg of the wire loop may be severed at the splicing means. Both of these concepts are illustrated, for example, in FIG. 2C. In some connections, such as those illustrated in FIGS. 2B and 2C, when one leg of the U-shaped wire guide is positioned to be adjacent to one end of the metallic element, the opposite leg of the U-guide is at least partially accessible from the exterior of the connection. This accessibility will be further mentioned in the description of the mandrel holder to follow.

MANDREL HOLDER

Figure 8:
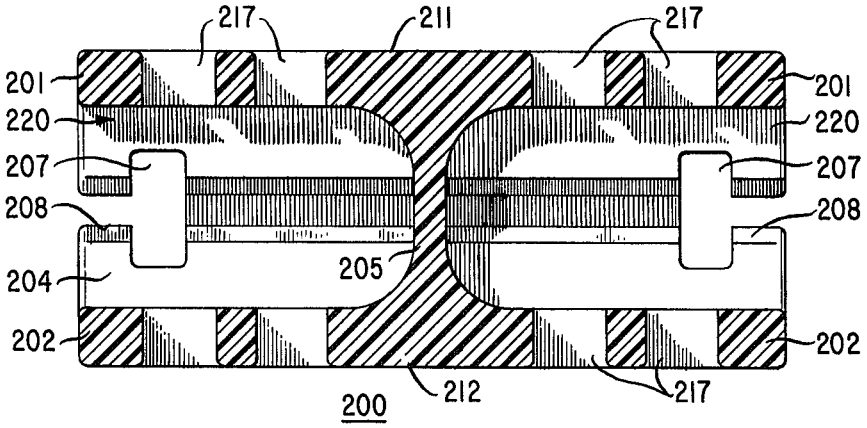
FIG. 8 is a sectional side view of the mandrel holder.

FIGS. 5–8 illustrate the construction of the mandrel holder 200, which consists basically of a top face 211 and a bottom face 212 joined by two side walls 203 and 204 and a central web 205. The edges 201 and 202 of the faces 211 and 212 define the open mouth of a mandrel-receiving chamber 220 on either side of holder 200, as seen in FIG. 8. Two snap holes 206 in end wall 203, and two corresponding snap holes 207 in end wall 204, each intersect a tapered slot 208 formed along the interior surface of the respective end walls 203, 204. The slots 208 terminate at the webbing 205, as seen in FIG. 8. Slots 208 act as a guide to receive the tapered runners 118 of a mandrel 100; and the knobs 119 on the mandrel lockingly engage the end wall snap holes 206, 207.

Figure 5:
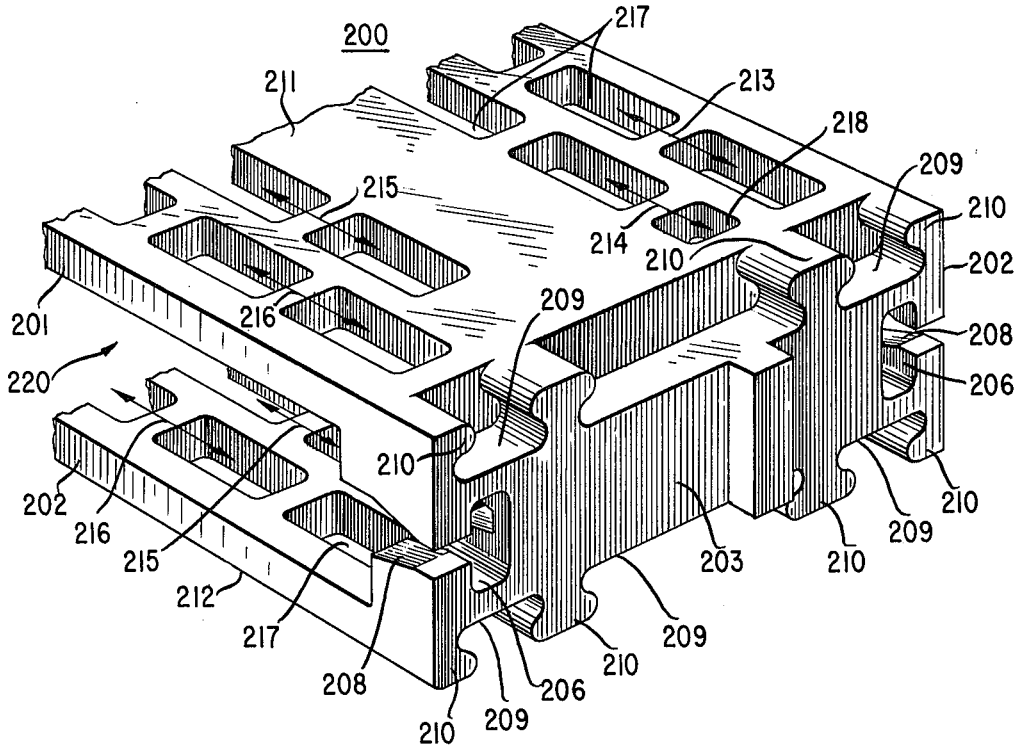
FIG. 5 is a partial isometric view of the mandrel holder.

Another set of snap holes 209 are formed along the top and bottom edges of both end walls 203, 204, those in end wall 203 being shown in FIG. 5. Each snap hole entrance is formed by resilient arms 210 whose top surfaces converge in smooth curves which define an entrance neck narrower than the bottom portion of the snap holes 209.

Figure 6:
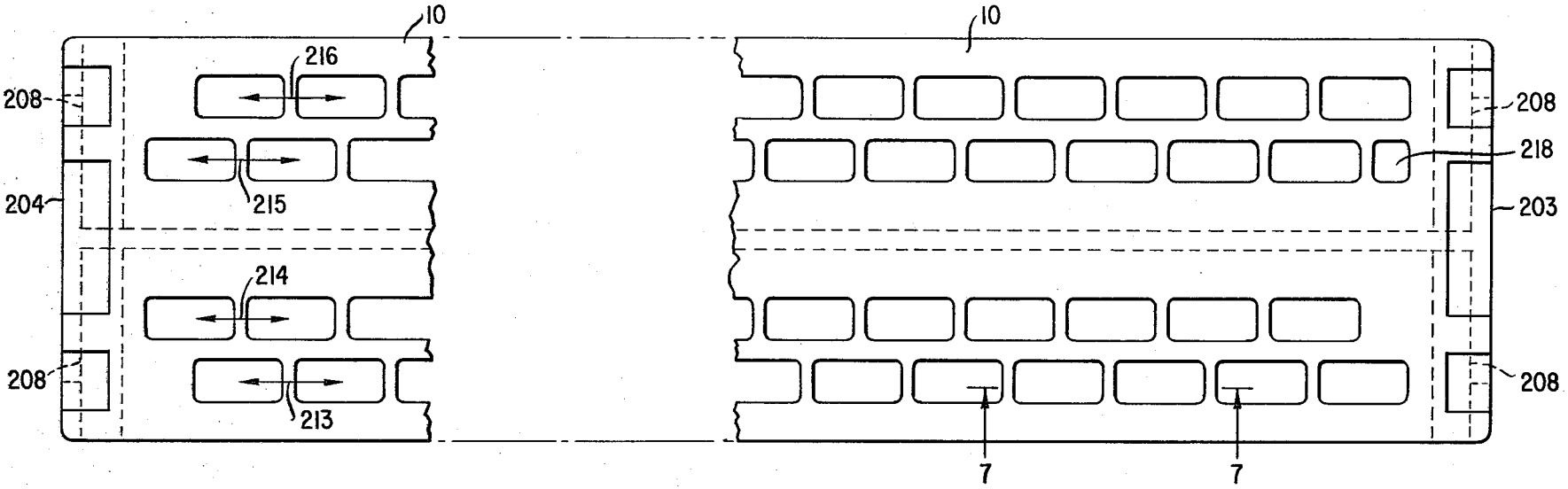
FIG. 6 is a partial top view of the mandrel holder.
Figure 7:
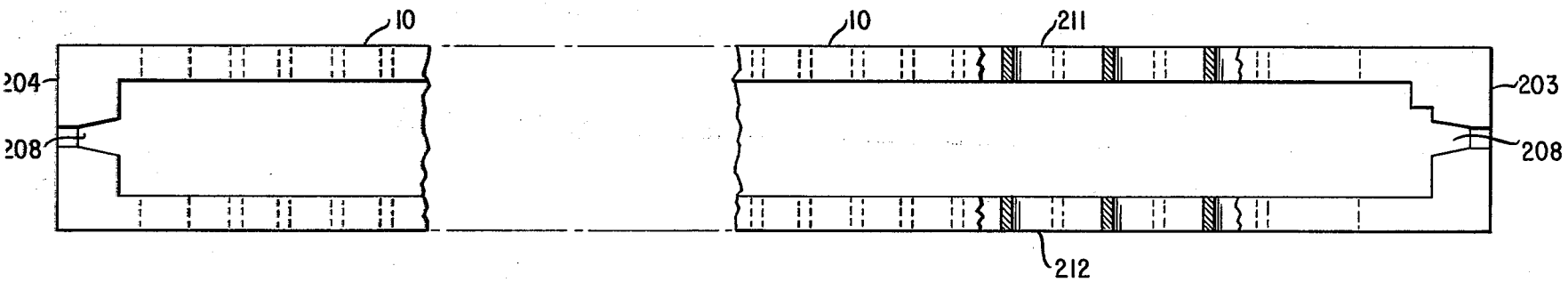
FIG. 7 is a partial front view of the mandrel holder.

Along the top surface 211, and the bottom surface 212 of mandrel holder 200 are located four rows 213, 214, 215, 216 of elongate holes 217 denoted by arrows in FIG. 5. Each hole connects through to the chambers 220 and constitutes contact entry or access holes. The access holes 217 of row 213 are staggered in relation to the access holes 217 of the adjacent row 214. Thus, as illustrated in FIG. 6, the centers of holes 217 of row 213 are in alignment with the respective walls which separate the holes 217 of row 214. In similar fashion, the contact entry holes 217 in row 215 are staggered in relation to the holes 217 of row 216. In the illustrative embodiment shown, the contact entry holes 217 of rows 214 and 215 are in alignment with each other, as are the entry holes 217 of the exterior rows 213, 216. A keyhole 218 provided in a single one of the rows, for example, row 215, as shown, renders the mandrel holder top surface 211 asymmetrical about its longitudinal center line. Asymmetry assures that the receptacle 150 will be properly oriented where engaged with the contact module 300.

CONTACT MODULE

Figure 9:
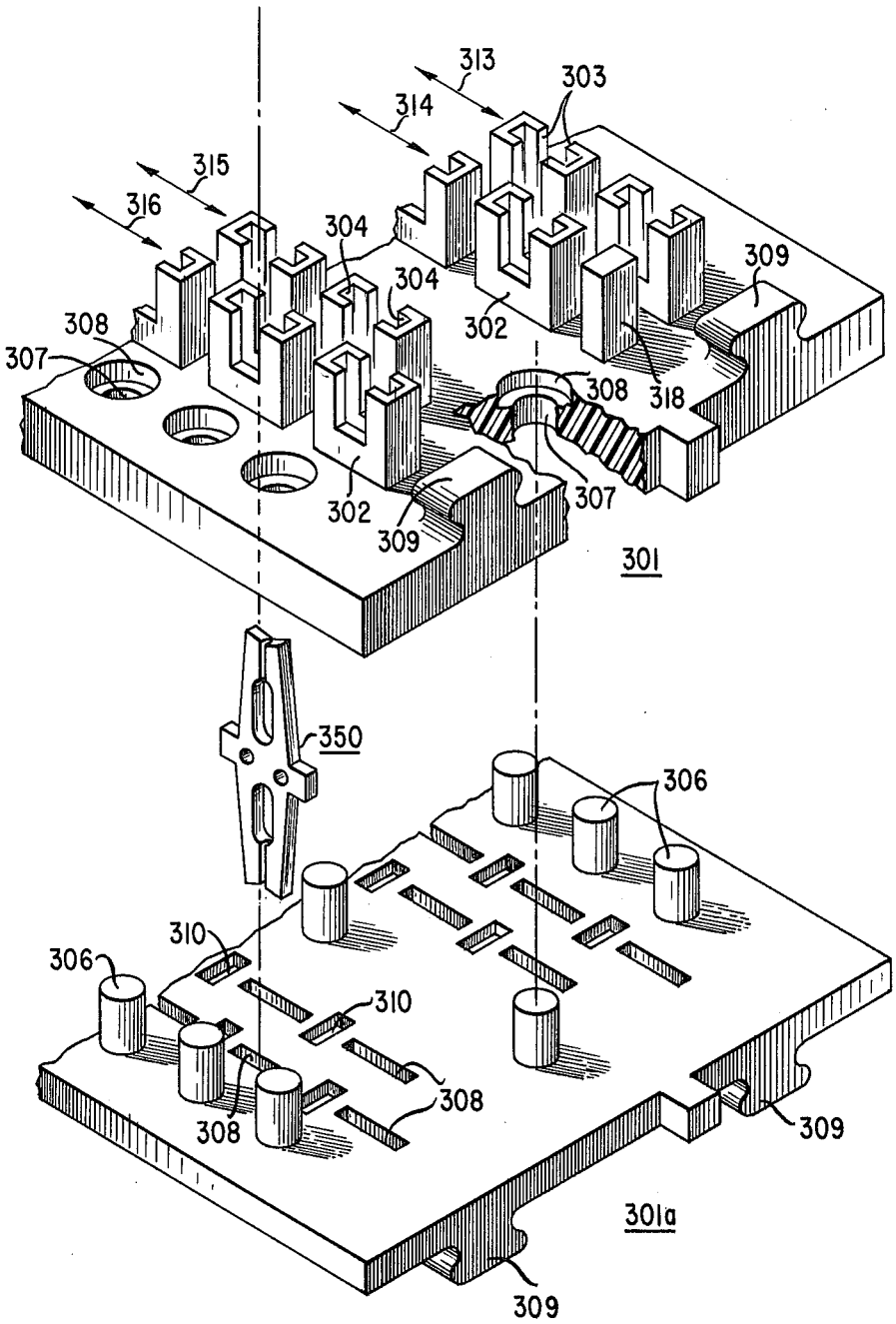
FIG. 9 is a partial isometric exploded view of a two-section contact module.
Figure 9A:
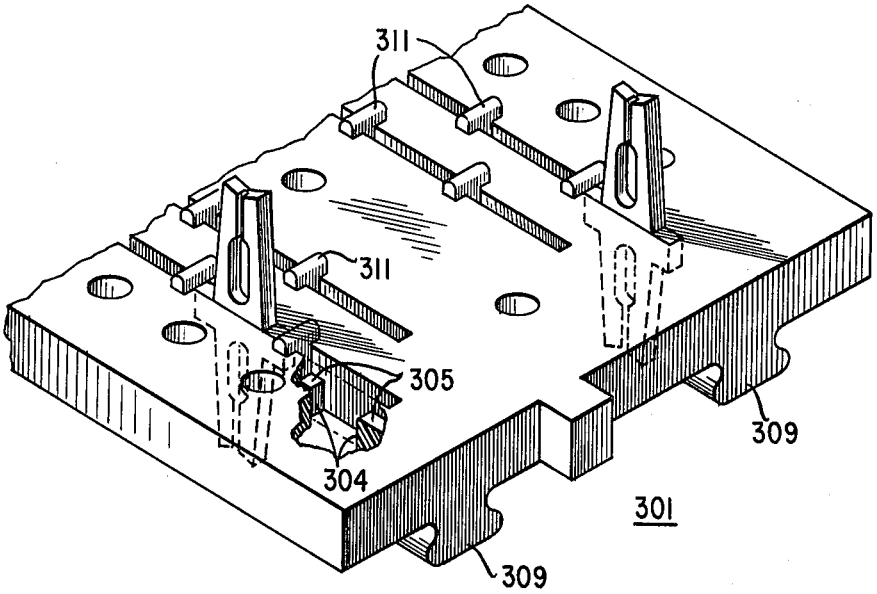
FIG. 9A is a partial isometric view of the inner side of the module top section.
Figure 9B:
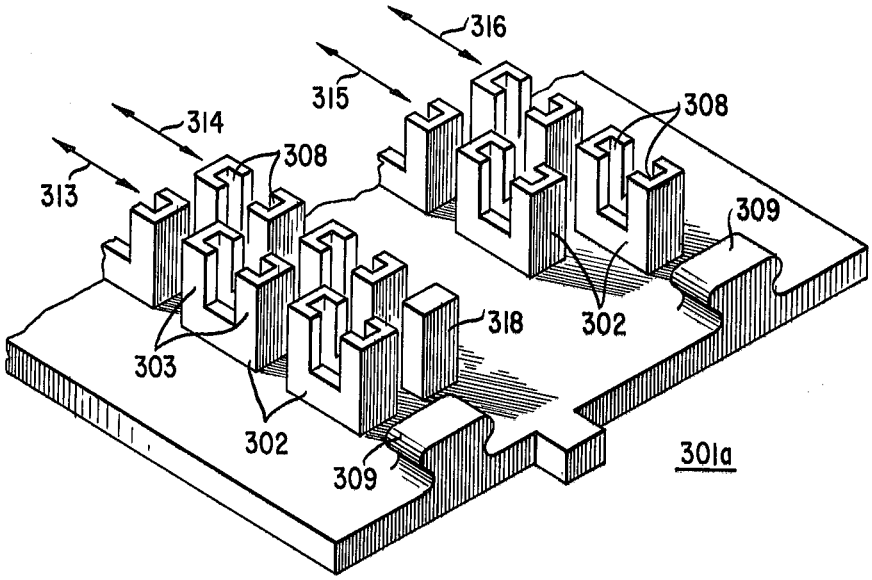
FIG. 9B is a partial isometric view of the outer side of the module bottom section.

To simplify description of the contact module details, the module 300 is shown in FIG. 9 in two halves which for convenience are separately fabricated and then assembled to form the module 300 as shown in FIG. 1. The underside of top half 301 is shown in FIG. 9A; and the underside of bottom half **301*a* is shown in FIG. 9B. Top half 301, except for its greater thickness and pin receiving holes is basically similar to bottom half 301*a***.

Figure 10:
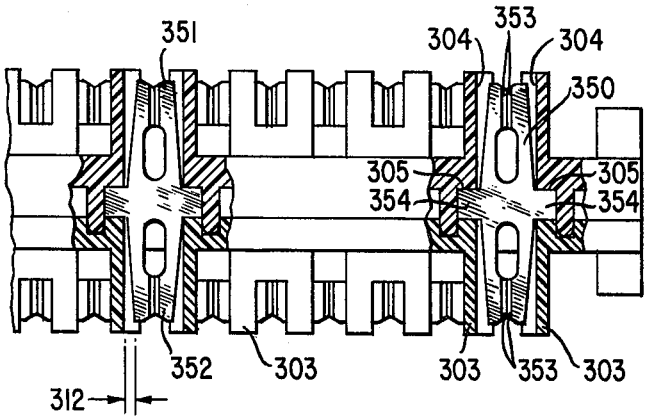
FIG. 10 is a partial sectional side view of the contact module.

Along the exterior surface of top half 301 as indicated by arrows are located four rows 313, 314, 315 and 316 of contact towers denoted 302. Each contact tower 302 consists of a pair of facing risers 303 with a space therein between. The interior wall of each riser 303 includes a slot 304. As seen in FIG. 9A, the slots 304 of top half 301 are carried vertically down through the contact towers 302. Each slot 304 is stepped to define two ledges 305 as seen in FIGS. 9A and 10. Beginning at the step, the slot 304 widens and is carried through to the interior surface of the top half 301.

The top half 301 and bottom half 301A are assembled as shown in FIG. 9 by insertion of the stacking pins 306 into respective ones of stacking holes 307. With the two interior surfaces of the halves 301, 301A contacting, the pins 306 protrude beyond the top surface of half 301. The two halves 301, 301A are then affixed to each other by peening or cold flowing the tops of the pins 306 down so as to fill the expanded well portions 308 of the stacking holes 307. The forming of contact module 300 by fitting together of two halves by means of the stacking pins and holes is a useful construction expedient; but other forming and fitting techniques readily may be envisioned.

When so assembled, the top and bottom halves **301, 301*a* of the contact module 300 are configured as shown in FIGS. 1 and 10. Each of the contact towers 302 of the row 313 of the top half 301 portrayed in FIG. 9 is in juxtaposition with the corresponding contact towers 302 of the row 313 shown in FIG. 9B. The slots 304 in the interior surfaces of the facing risers 303 of bottom half 301*a* are the same in width as the slots 304 of top half 301 shown in FIG. 9. When the two halves are assembled, the slots 308 are in alignment with the corresponding slots 304, as seen in FIG. 10**.

The contact towers 302 of row 313 are staggered in relation to the contact towers 302 of row 314, such that a plane equidistant between two facing risers 303 of a given contact tower 302 of row 314, would be equidistant between the adjacent non-facing risers 303 of the two closest contact towers 302 of the row 313. A similar staggering occurs between the contact towers 302 of the row 315 and 316. The contact towers 302 of the two interior rows 314, 315, are in horizontal alignment with each other, as are the contact towers 302 of the two exterior rows 313, 316.

Snap arms 309 extend out from the edges of the exterior surfaces of top half 301 and bottom half **301*a*. A total of eight snap arms 309, four on each end, are provided in the illustrative embodiment, to engage the corresponding snap holes 209 of mandrel holders to which as seen in FIG. 1A the connector module 300** may be connected.

Insulation-piercing slotted beam connectors 350 are assembled into the contact module 300, as illustrated for example, in FIG. 10 and in FIG. 1. The connector or contact 350 is double-ended, thereby providing slotted beam ends 351 and 352. As seen in FIG. 11A, each slotted beam end 352 has opposing knife edges 353 which engage and pierce the insulation of a conductor and thereafter make direct metallic contact with the wire.

Each connector 350 includes mounting tabs 354. As shown in FIG. 9A, tabs 354 engage shoulders 305 of the module 300, and are held in position by the capturing interior surface of a lower half 301A, which, as seen in FIG. 10, provides a matching shoulder **305*a***.

Each of the corresponding slots 304, 308 of the respective juxtaposed contact towers 302, form a loose housing around the included connector 350. In order to provide enhanced electrical isolation between adjacent contacts 350, a series of cavities 310 seen in FIG. 9 are formed between adjacent slots 308 in each of the rows 313–316. Extending out from the interior surface of top half 301, as shown in FIG. 9A, is a corresponding series of risers 311 formed to fit snugly in the cavities 310.

When inserted in the cavities 310, the risers 311 act to increase the breakdown voltage as a result of increasing the effective air gap between the contacts 350.

Figure 11:
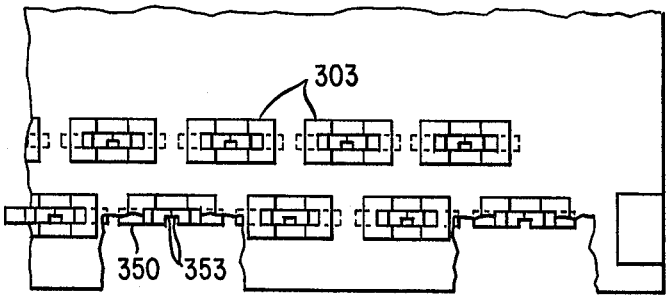
FIG. 11 is a partial top view of the contact module.
Figure 11A:
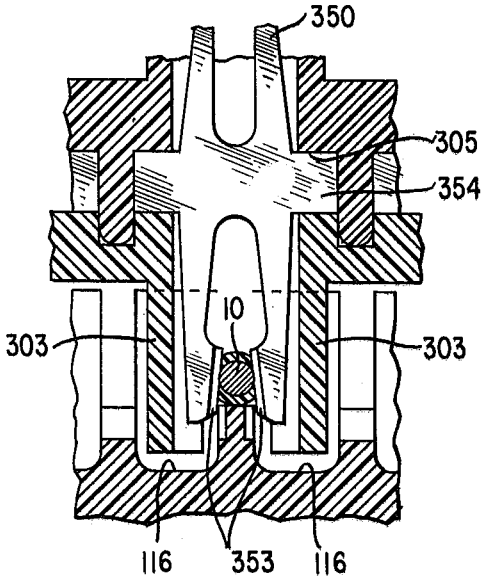
FIG. 11A is a sectional side view showing a contact module installed on a mandrel holder or receptacle.

As seen in FIGS. 10 and 11, the slots 304, 308 which surround each beam connector 350 afford a clearance denoted 312 to permit the opposing slotted beams to open up as they engage the insulation and conductor of a wire.

ASSEMBLING AND USING THE CONNECTOR

FIG. 1 depicts an exemplary use of the connector of the present invention, in a twelve-pair splice connection.

The twelve tip conductors of the conductor group 11 and twelve ring conductors of the group 13 constitute for example one end of a set of twelve conductor pairs. The conductors are fanned out on two mandrels such as mandrel 100, in a desired sequence.

Fanning may be aided by additional expedients such as numerical mark, color or other designators identifying a particular sequence of mandrel risers 105. Placement of the conductor groups 11, 13 onto respective mandrels may be aided by machine means or may be done manually. In either case, each individual wire is inserted snugly down between toothed risers 105, 106 onto a respective floor 101 on one side of a mandrel 100 and then wrapped around through the wire guide 103, back over the corresponding floor 101 on the opposite side of the mandrel where it is gripped a second time between toothed risers 107, 108. In similar fashion, the tip conductors of wire group 12 and the ring conductors of wire group 14 are assembled respectively onto two other mandrels. For the type splice being illustrated, the wires are terminated, as by bringing a knife edge down onto the wire at the points denoted 120 on each of the mandrels, as illustrated in FIG. 4.

After the wires are mounted onto the mandrels, the latter are inserted into the respective mouths 220 of the mandrel holder 200. The runners 118 of each mandrel 100 engage and slide on the tapered slots 208. Insertion of each mandrel 100 centers each of the twelve wires of its wire group in relation to two corresponding ones of the contact entry holes 217, by virtue of the appearance of each wire of the group on two sides of its mandrel.

Adjacent wires mounted upon mandrels 100 do not appear beneath adjacent entry holes in the same row. For example, the odd numbered wires of group 11 appear beneath the holes 217 of row 216 while even numbered wires of group 11 appear beneath the holes 217 of row 215.

In the foregoing fashion, a first pair of mandrels is mounted into a first wire holder 200; and then a second pair of mandrels is mounted into a second wire holder 200. The two assemblies thus produced, which for convenience may be termed receptacles, are each at this point ready to be joined to a contact module 300.

Mounting of receptacles 150 on one side of a contact module 300 is illustrated in FIG. 1A. Contact towers 302 extend from either side of the module 300, and align with the entry holes on one side of one of the receptacles 150. The keyhole 218 of a first receptacle 150 is engaged by the key 318 located on one side of contact module 300. A second key 318 shown in FIG. 9B and located symmetrically to the key 318 on the topside of module 300, is engaged into the keyhole 218 of a second receptacle 150. This arrangement ensures that each receptacle 150 can only be mounted in one orientation on a given side of contact module 300. This orientation assures that a given row of entry windows such as row 213 will only receive the corresponding row 313 of contact towers. The alignment of hole row 213 and with tower row 313 determines whether the given mandrel holder 200 is mounted on one side or the other side of the contact module 300.

The mandrel holders 200 snap mount to contact module 300 in this illustrative embodiment, by virtue of snap arms 309 of the module engaging into the corresponding snap holes 209 of the mandrel holder 200. In the process of this snap-mounting just described, forty-eight individual connections between wire groups 11–12, and between wire groups 13–14 are afforded. As the receptacle 150 and module 300 are pressed together, the knife edges 353 of each connector 350 first encounter the insulation of a conductor 10. The insulation, typically plastic, is gently penetrated and displaced as the beams 351 and 352 spread under the load. The sharp interior knife edges 353 then make pressure contact with the metal of each wire. In this sequence, each connector 350 is centered over its associated wire at a point above the reduced width section 112. The risers 303 which house each contact 350, as well as the beam ends 351, 352, extend down into the respective two clearance wells 116. Because of the described staggered positioning of the slotted beam contacts 350, two adjacent wells 116 are dedicated to just one contact 350 and its associated risers 313.

After the mandrels 100 are inserted into the holders 150 and the two resulting receptacles are assembled onto the contact module 300, it is normally advantageous to dress back the wire groups 11–14 as seen in FIG. 1A. The wires do not extend beyond the width of the assembly and thus keep the entire assembly advantageously compact. Also, when dressed, as shown in FIG. 1A, the wire groups 11–14 are afforded additional strain relief to further protect the just-made electrical connection between the wires.

In the foregoing example, all tip conductors to be connected are on one side of the connector and all ring conductors are on the other side. It is equally possible, however, to alternate tip and ring connections along one side of the connector. This concept is illustrated in notation of FIG. 1A.

Figure 12:
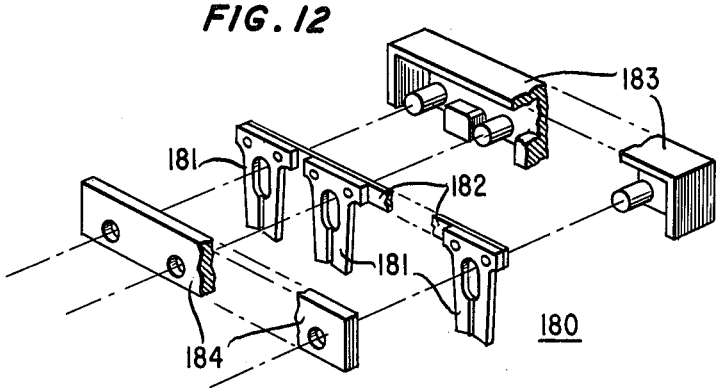
FIG. 12 is a schematic perspective exploded view of a strapping contact assembly.

Wires disposed under adjacent contact entry holes 217 in one row of a receptacle, may be bridged by special hardware, such as shown in FIG. 12. Thus, connecton of every other wire of the group 11 may be achieved by the connector 180, which consists of several single-ended slotted beam connectors 181 bussed together by bar 182 and mounted in a housing consisting of box 183 and box top 184. This hardware provides a set of in-line connectors which may, for example, fit into any of the slot rows 213–217 depicted in FIG. 5.

Figure 12A:
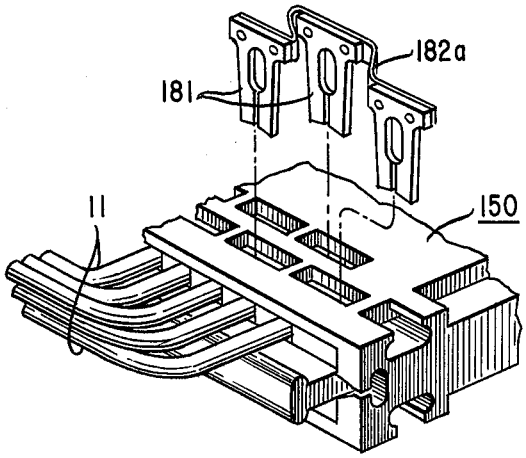
FIG. 12A is a schematic perspective view of an alternate form of strap.

Joining of immediately adjacent wires in two adjacent rows is achieved by a set of similar slotted beams 181, shown in FIG. 12A. These are joined by a metal bus **182*a* curved to position the beams 181 in a staggered array. This type connection 180*a*, when sufficiently extended, provides for bridging of all wires of, for example, group 11**.

Figure 13A:
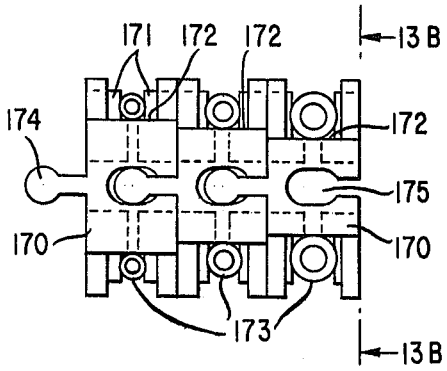
FIGS. 13A, 13B, and 13C show various top, frontal and side views of a single wire mandrel.
Figure 13B:
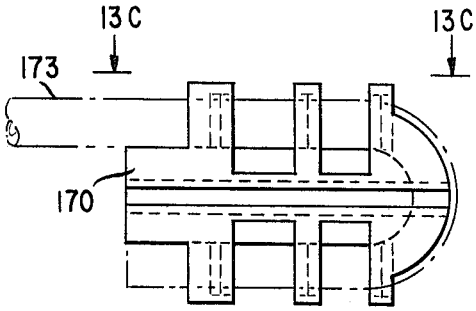
Figure 13C:
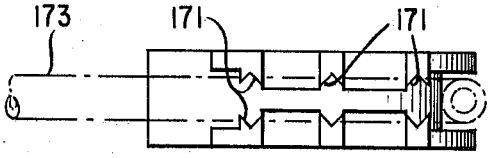

FIGS. 13A, B, and C depict a version of the present invention involving a mandrel designed to accommodate a single wire. This mandrel, designated 170, advantageously is provided in versions having the same width as seen in FIG. 13A; but advantageously having varying clearances between the wire grippers 171 as well as varying heights of the wire support floors 172. This arrangement can accommodate different gauge sizes for the wires 173 while maintaining each wire both centered with respect to its support floor 172 and spaced centrally with respect to each of the grippers 171. The mandrels 170 are connected to each other by engagement of arms 174 into slots 175.

Figure 14:
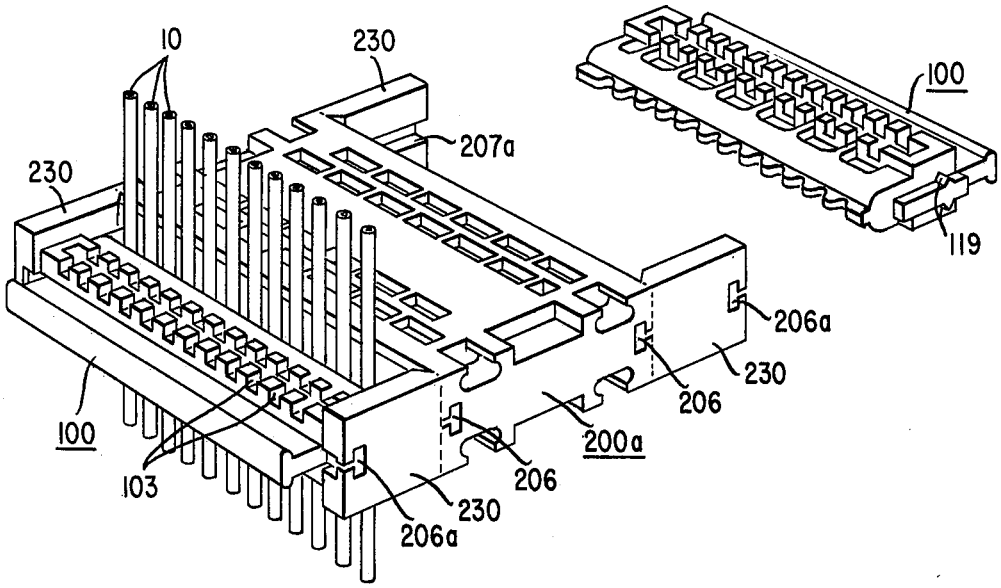
FIG. 14 is an exploded schematic perspective diagram showing an alternate version of mandrel holder.

An alternate mandrel holder, permitting an occasionally convenient method of wire loading, is depicted in FIG. 14. The holder, denoted 200*a* is substantially similar to the holder 200 depicted in FIGS. 5–8, except that holder 200*a* includes extension arms 230. A mandrel such as 100 is inserted into the holder 200*a* in the usual manner, until its nubs 119 engage the outer snap holes 206*a*, 207*a*. In this position, the wire guides 103 of the mandrels 100 are closely adjacent to the entrance to the interior chamber of holder 200*a*. Wires 10 are then fed through respective wire guides 103 until the mandrel is loaded, the wires 10 being generally straight and vertical. Then, each mandrel 100 is urged into the holder chamber until, as in the first version, the nubs 119 engage the interior snap holes 206, 207. In this position, the wires form themselves around their respective mandrels in the manner depicted in FIG. 2*c*, for example.

Figure 15:
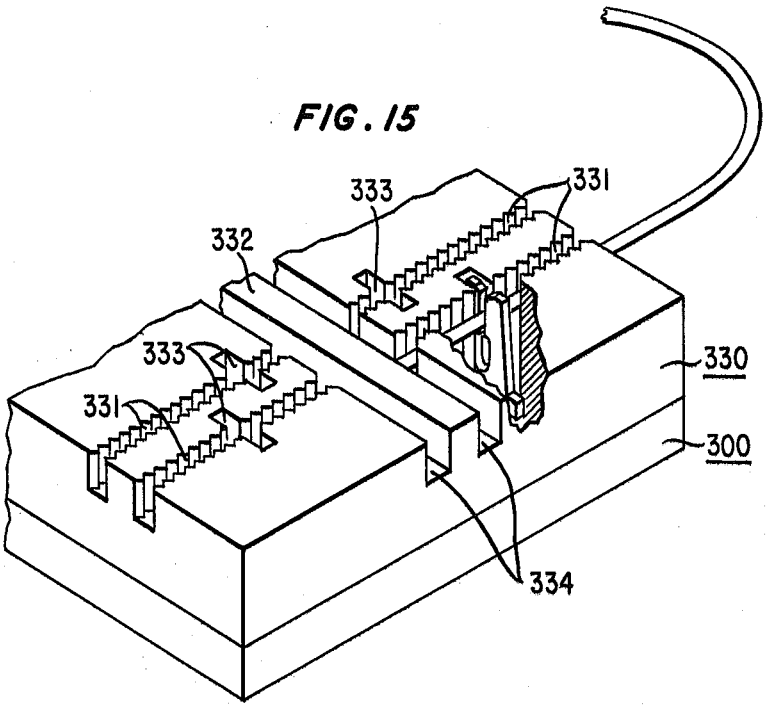
FIG. 15 is a schematic view of a structure for connecting wires by direct insertion into the slotted beam connectors.

A direct insert of wires 10 into the contact module 300, without use of a receptacle such as 150, is depicted in FIG. 15. A block 330 having several parallel wires guides 331 on either side of a central rib 332, provides the basic member. The guides 331 include slots 333 configured in the same juxaposition as the slotted beam connectors 350 of a contact module 300. Wires are inserted into guide 331 and into the slotted beam connectors 350. Then, the wire end is dressed or severed by a knife edge tool (not shown) using anvil surface 334.

All non-metal parts depicted above may be fabricated advantageously by conventional moulding techniques using polycarbonate, a material known for its high strength and good yield properties.

A host of mounting arrangements for the assembly of FIG. 1A and of the assemblies herein shown, can be devised, for example, by taking advantage of the flange extensions 360 of the mandrel holders and of the contact module, as depicted in FIG. 1*a*.

The present connector structure accommodates the interconnecting of substantially any desired two or more wires. "Vertical" interconnection modes, for example, are illustrated in FIGS. 2B, 2C and 2D; while "horizontal" interconnection modes may be achieved by the hardware illustrated in FIGS. 12 and 12A. The two modes can be combined to selectively interconnect a very large number of wires where desired. In addition, it is readily possible to extend the hardware illustrated in FIG. 12A to connect together two or more wires mounted on opposite sides of a center plane which symmetrically divides the connector assemblies illustrated, for example, in FIGS. 2B, 2C and 2D.

No screws or metallic securing hardware are necessary to maintain the assembly of the parts. Advantageous also is the fact that access may readily be gained to the wires for testing of a fully assembled connection, via for example, the access holes or windows present in the outer surface of the completed connection such as shown in FIG. 1A.

In the preceding description the term "wire" has been used to denote both insulated and uninsulated conductors. If a given example is identified with the telephone art, the wires may be assumed to be insulated. The connector assemblies described, however, are not limited to use with insulated conductors, nor for that matter, are they limited only to the telephone industry. Uses will readily be recognized in, for example, commercial electronic equipment, back-plane wiring, automotive wiring, and residential and commercial electrical wiring.

The spirit of the invention is embraced in the scope of the claims to follow.

What is claimed is:

1. A connector for electrically joining at least two wires, comprising in combination:

a wire mandrel comprising:

first and second wire-receiving surfaces; and one or more wire guide channels common to each said surface for positioning a given wire along both of said surfaces, said wire guide channels including wire insulation gripping teeth for holding said wire adjacent to both of said surfaces;

a unitary mandrel holder comprising:

a first and a second face defining therebetween an open-ended interior chamber for receiving said mandrel;

each said face having an access hole, with two such holes being aligned on opposite sides of each one of said wire guide channels when said mandrel is inserted into said chamber; and a contact module comprising:

one or more contact-receiving cavities each positioned to align with an access hole pair; and a contact element having two like ends and contained in each of said cavities for engaging two different positioned wires carried on oppositely disposed first wire-receiving surfaces of two different wire mandrels to effect the connection therebetween.

2. A connector pursuant to claim 1 wherein said wire guide channels each include a support floor and said floor includes a section of reduced width at the point of contact between said wire and said contact element.

3. Apparatus pursuant to claim 1, wherein said wires are insulated.

4. A connector pursuant to claim 1, wherein said contact elements are slotted beams.

5. A connector pursuant to claim 4, further including means for slideably mounting said mandrel in said interior chamber and for retaining said mandrel in an inserted position in said chamber.

6. Apparatus pursuant to claim 5, further comprising:

means for retaining said mandrel in a position adjacent to said open end of said chamber with sufficient clearance to permit wires to be loaded thereinbetween.

7. Apparatus pursuant to claim 5 further including means for fastening said mandrel holder onto said contact module with said mandrel in its said inserted position, said contact elements extending into respective said access holes.

8. Apparatus pursuant to claim 7 wherein said contact module further comprises:

towers extending from either side around each said extending contact element; each said tower consisting of a pair of opposed risers spaced apart to accommodate a said wire thereinbetween, the towers fitting into respective ones of said access holes of said mandrel holder.

9. A connector for electrically joining a first group of wires to a second such group comprising in combination:

a wire mandrel for each said group, each mandrel comprising:

two opposite wire-receiving surfaces; and wire guide channels, each channel being common to both said surfaces, for presenting each wire of said group on both of said wire-receiving surfaces, said wire guide channels including wire insulation gripping teeth for holding each said wire adjacent to both of said surfaces;

a unitary mandrel holder for each said group, each holding comprising:

a first and a second face defining an open-ended interior chamber for receiving each said mandrel;

the faces including aligned access hole pairs respectively positioned adjacent to corresponding ones of said wire guide channels when the associated mandrel is inserted into its holder; and a contact module comprising:

contact-receiving cavities spaced to align with respective ones of said access hole pairs;

each said cavity containing a contact element having two like ends for engaging different wires carried on oppositely disposed wire receiving surfaces of different wire mandrels to effect a connection between said first group of wires and said second group of wires.

10. A connector for electrically joining a first group of tip and ring wire pairs with a second group of tip and ring wire pairs, comprising in combination:

first and second wire mandrels for receiving respectively the tip wires of the first and second said groups;

third and fourth wire mandrels for receiving respectively the ring wires of the first and second said groups, each mandrel comprising:

two opposite wire-receiving surfaces; and wire guide channels, each separate channel extending to both said wire-receiving surfaces, said wire guide channels including wire insulation gripping teeth for holding said wire pairs adjacent to both of said surfaces;

first and second unitary mandrel holders for receiving, respectively, the two mandrels associated with the tip and ring wires of said first group and the two mandrels associated with the tip and ring wires of said second group, each said mandrel holder comprising:

a first and a second face joined by two side walls and a central web between the two faces in the two side walls, defining two open-ended chambers for receiving said two associated mandrels;

each face including aligned access hole pairs which when the two said associated mandrels are inserted into the holder are respectively positioned adjacent to corresponding ones of said wire guide channels;

and a double-sided contact module comprising:

contact-receiving cavities extending between the two modules sides and positioned to align with the access holes of a said mandrel holder;

each said cavity containing a contact element having two like ends for effecting the engagement of said wire pairs of said first group with said wire pairs of said second group;

said first and second mandrel holders being mateable on the respective said sides of said module.

11. A connector for electrically joining a first and a second wire comprising in combination:

first and second wire mandrels, each comprising a continuous wire guide channel defined by generally parallel entrance and exit legs, opening onto the front side of said mandrel and joined by a crossover portion formed across the rear side of said mandrel, each said wire guide channel including wire insulation gripping teeth for holding a wire adjacent to both oppositely disposed outer surfaces of said wire mandrel;

first and second unitary mandrel holders, each comprising a first and a second face, and an open-ended interior chamber between said faces for receiving one of said mandrels; each said face including an access hole;

and a connector module comprising:

a body portion having two opposite sides;

and a contact element having two like ends mounted in said body portion and extending out from either side sufficiently to permit said element to enter a said access hole and intersect with one of the legs of a wire guide channel of a said mandrel when mounted in said holder to effect the connection of said first wire to said second wire.

12. A connector assembly for electrically joining at least two wires comprising:

a wire mandrel having first and second wire receiving surfaces, each of said surfaces having integral therewith a plurality of wire guide channels having insulation gripping teeth for securely holding a wire in engagement with said surfaces of said mandrel;

a unitary mandrel holder including first and second spaced-apart faces which form an open-ended interior chamber for receiving said mandrel, said faces having at least two linear arrays of spaced-apart, laterally offset apertures therein aligned so as to be in corresponding registration with said wires on said mandrel when said mandrel is inserted into said chamber;

a contact module having a plurality of spaced-apart, contact-receiving cavities therein, each of said cavities surrounded by an oppositely directed tower extending from opposed surfaces of said module and positioned so as to be alignment with said apertures in said mandrel holder; and a double-ended slotted beam contact element housed in each of said tower-surrounded cavities for effecting the interconnection or correspondingly positioned wires carried on different mandrels.

* * * * *